US006755878B2

(12) United States Patent
Paxton et al.

(10) Patent No.: US 6,755,878 B2
(45) Date of Patent: Jun. 29, 2004

(54) ABRASIVE ARTICLES AND METHODS OF MAKING AND USING THE SAME

(75) Inventors: Richard T. Paxton, Ames, IA (US); David F. Slama, City of Grant, MN (US); Mark A. Swanson, Ames, IA (US); Robert A. Follensbee, Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 52 days.

(21) Appl. No.: 10/211,755

(22) Filed: Aug. 2, 2002

(65) Prior Publication Data

US 2004/0020133 A1 Feb. 5, 2004

(51) Int. Cl.[7] ..... B24D 11/02; B24D 11/00

(52) U.S. Cl. ..... 51/298; 51/295; 51/297; 51/307; 51/308; 51/309; 451/28

(58) Field of Search ..... 51/298, 295, 297, 51/307, 308, 309; 451/28

(56) References Cited

U.S. PATENT DOCUMENTS

| | | | |
|---|---|---|---|
| 2,958,593 | A | 11/1960 | Hoover et al. |
| 4,314,827 | A | 2/1982 | Leitheiser et al. |
| 4,331,453 | A | 5/1982 | Dau et al. |
| 4,397,905 | A | 8/1983 | Dettmer et al. |
| 4,518,397 | A | 5/1985 | Leitheiser et al. |
| 4,588,419 | A | 5/1986 | Caul et al. |
| 4,623,364 | A | 11/1986 | Cottringer et al. |
| 4,631,220 | A | 12/1986 | Clifton |
| 4,652,275 | A | 3/1987 | Bloecher et al. |
| 4,734,104 | A | 3/1988 | Broberg |
| 4,734,335 | A | 3/1988 | Monzer |
| 4,737,163 | A | 4/1988 | Larkey |
| 4,744,802 | A | 5/1988 | Schwabel |
| 4,751,138 | A | 6/1988 | Tumey et al. |
| 4,761,320 | A | 8/1988 | Coburn, Jr. |
| 4,781,957 | A | 11/1988 | Brown et al. |
| 4,799,939 | A | 1/1989 | Bloecher et al. |
| 4,881,951 | A | 11/1989 | Monroe et al. |
| 4,894,060 | A | 1/1990 | Nestegard |
| 4,927,431 | A | 5/1990 | Buchanan et al. |
| 4,991,362 | A | 2/1991 | Heyer et al. |
| 5,011,508 | A | 4/1991 | Wald et al. |
| 5,078,753 | A | 1/1992 | Broberg et al. |
| 5,090,968 | A | 2/1992 | Pellow |
| 5,108,463 | A | 4/1992 | Buchanan |

(List continued on next page.)

FOREIGN PATENT DOCUMENTS

| | | | |
|---|---|---|---|
| CA | 2092281 | | 9/1993 |
| DE | 38 44 261 | A1 | 7/1990 |
| EP | 0 934 802 | A2 | 8/1999 |
| EP | 1 050 374 | A2 | 11/2000 |
| GB | 2 275 007 | A | 8/1994 |
| JP | 60-217143 | | 10/1985 |
| JP | 6-33022 | | 2/1994 |
| JP | 6-116538 | | 4/1994 |
| JP | 10-292159 | | 11/1998 |
| JP | 2000-63779 | | 2/2000 |
| JP | 2000-3348777 | | 12/2000 |
| WO | WO 97/13633 | | 4/1997 |
| WO | WO 99/17630 | | 4/1999 |
| WO | WO 00/73082 | A1 | 12/2000 |
| WO | WO 01/15820 | A1 | 3/2001 |
| WO | WO 01/70897 | A2 | 9/2001 |

OTHER PUBLICATIONS

U.S. patent application Ser. No. 10/044,367, Microstructured Release Liner, filed Oct. 1, 2002.

*Primary Examiner*—Michael Marcheschi
(74) *Attorney, Agent, or Firm*—Bradford B. Wright

(57) ABSTRACT

Abrasive articles have an adhesive layer in contact with a liner having protrusions that contact the adhesive layer.

49 Claims, 4 Drawing Sheets

U.S. PATENT DOCUMENTS 5,137,542 A 8/1992 Buchanan et al.
5,139,978 A 8/1992 Wood
5,152,917 A 10/1992 Pieper et al.
5,201,916 A 4/1993 Berg et al.
5,203,884 A 4/1993 Buchanan et al.
5,227,104 A 7/1993 Bauer
5,273,805 A 12/1993 Calhoun et al.
5,328,716 A 7/1994 Buchanan
5,366,523 A 11/1994 Rowenhorst et al.
5,378,251 A 1/1995 Culler et al.
5,417,726 A 5/1995 Stout et al.
5,429,647 A 7/1995 Larmie
5,436,063 A 7/1995 Follett et al.
5,490,878 A 2/1996 Peterson et al.
5,496,386 A 3/1996 Broberg et al.
5,498,269 A 3/1996 Larmie
5,505,747 A 4/1996 Chesley et al.
5,520,711 A 5/1996 Helmin
5,549,962 A 8/1996 Holmes et al.
5,551,963 A 9/1996 Larmie
5,556,437 A 9/1996 Lee et al.
5,560,753 A 10/1996 Schnabel et al.
5,591,239 A 1/1997 Larson et al.
5,609,706 A 3/1997 Benedict et al.
5,626,639 A 5/1997 King
5,679,302 A 10/1997 Miller et al.
5,681,361 A 10/1997 Sanders, Jr.
5,700,302 A 12/1997 Stoetzel et al.
5,807,161 A 9/1998 Manor et al.
5,845,375 A 12/1998 Miller et al.
5,858,140 A 1/1999 Berger et al.
5,942,015 A 8/1999 Culler et al.
5,954,844 A 9/1999 Law et al.
5,961,674 A 10/1999 Gagliardi et al.
5,975,988 A 11/1999 Christianson
6,017,831 A 1/2000 Beardsley et al.
6,059,850 A 5/2000 Lise et al.
6,142,858 A 11/2000 Luedeke
6,197,397 B1 3/2001 Sher et al.
6,203,885 B1 3/2001 Sher et al.
6,207,246 B1 3/2001 Moren et al.
6,261,682 B1 7/2001 Law
2001/0036529 A1 11/2001 Calhoun et al.
2001/0037393 A1 11/2001 Park et al.
2001/0039176 A1 11/2001 Feeley
2002/0090901 A1 7/2002 Schutz et al.

ABRASIVE ARTICLES AND METHODS OF MAKING AND USING THE SAME

TECHNICAL FIELD

The present invention relates to abrasive articles, more particularly to abrasive articles having an adhesive layer.

BACKGROUND

Many abrasive articles, for example, coated abrasive or nonwoven abrasive articles in the form of sheets or discs, are commonly mounted onto a support pad during use. Typically, the purpose of the support pad is to provide the abrasive article with the necessary foundation required for a particular abrading application. For example, if the abrasive article is to be employed at high pressure (e.g., for high stock removal applications), the support pad will typically be durable, heat resistant, and rigid. If the abrasive article is to be employed for finishing contoured surfaces, the support pad will typically be soft and conformable.

For abrasive articles having a backing, one option for mounting the abrasive article onto the support pad involves a pressure-sensitive adhesive (i.e., PSA). For this option, the surface of the backing opposite the abrasive layer typically bears a layer of PSA. The PSA layer typically has sufficient adhesion to hold the coated abrasive article on the support pad for the intended abrading application.

As supplied to the user, a liner is typically bonded to the PSA layer of the abrasive article. The liner serves, for example, to protect the adhesive layer from foreign matter that may otherwise adhere to the PSA layer resulting in a lessened tack of the adhesive layer. Conventional liners are typically made of paper or polymeric film, and generally have a coating of a low adhesion material. Typically, the low adhesion material is in direct contact with the PSA layer. Examples of such low adhesion materials include polyethylene, silicones, fluoropolymers, and high molecular weight waxy materials. Removal of the liner thereby exposing the PSA layer can be a tedious process, as it typically requires separating (e.g., using fingernails) the liner from the PSA layer.

To facilitate removal of the liner, some abrasive articles have a disposable tab. Such abrasive articles are commonly formed by cutting (e.g., by die cutting) the abrasive article, and its associated liner, into a shape corresponding generally to a preferred size and shape (e.g., a disk or rectangle), but including an additional area which forms the tab. A cut that is made through the abrasive layer, backing, PSA layer, and optional layer(s) of the abrasive article, but not penetrating the liner, severs that portion of the abrasive article on the tab from that portion having the preferred shape. The tab can be easily grasped and used to remove the liner from the PSA layer, resulting in an abrasive article having the preferred shape. In practice, it is difficult to accurately control the depth of the cut that separates the tab from the abrasive article, and problems with cutting into or through the liner are common. In such cases, the tab may not function properly.

SUMMARY OF THE PRESENT INVENTION

In one aspect, the present invention provides a coated abrasive article comprising:

- a backing having a first major surface and a second major surface opposite the first major surface;
- an abrasive layer on at least a portion of the first major surface, wherein the abrasive layer comprises binder and abrasive particles;

- an adhesive layer on at least a portion of the second major surface; and
- a removable liner adhered to the adhesive layer, the liner comprising a base portion having protrusions extending therefrom, wherein at least some of the protrusions contact the adhesive layer.

In another aspect, the present invention provides a nonwoven abrasive article comprising:

- a backing having a first major surface and a second major surface opposite the first major surface;
- a nonwoven abrasive web on at least a portion of the first major surface, the nonwoven abrasive web comprising an open lofty fiber web, binder, and abrasive particles;
- an adhesive layer on at least a portion of the second major surface; and
- a removable liner adhered to the adhesive layer, the liner comprising a base portion having protrusions extending therefrom, wherein at least some of the protrusions contact the adhesive layer.

In another aspect, the present invention provides a method of making a coated abrasive article comprising:

- providing a backing having a first major surface and a second major surface opposite the first major surface;
- affixing an abrasive layer to at least a portion of the first major surface, the abrasive layer comprising a binder and abrasive particles;
- affixing an adhesive layer to at least a portion of the second major surface; and
- adhering a removable liner to the adhesive layer, the liner comprising a base portion and a plurality of protrusions extending from the base, by contacting the protrusions with the adhesive layer.

Typically, the abrasive layer is affixed to the first major surface prior to adhering the removable liner.

In another aspect, the present invention provides a method of making a nonwoven abrasive article comprising:

- providing a backing having a first major surface and a second major surface opposite the first major surface;
- affixing a nonwoven abrasive web to at least a portion of the first major surface, the nonwoven abrasive web comprising an open lofty fiber web, binder, and abrasive particles;
- affixing an adhesive layer to at least a portion of the second major surface; and
- adhering a removable liner to the adhesive layer, the liner comprising a first surface having a base portion and a plurality of protrusions, wherein the protrusions contact the adhesive layer.

Typically, the nonwoven abrasive web is affixed to the first major surface prior to adhering the removable liner.

In another aspect, the present invention provides a method of abrading a workpiece comprising:

- providing a coated abrasive article comprising:
  - a backing having a first major surface and a second major surface opposite the first major surface;
  - an abrasive layer on at least a portion of the first major surface, the abrasive layer comprising a binder and abrasive particles;
  - an adhesive layer on at least a portion of the second major surface; and
  - a removable liner adhered to the adhesive layer, the liner comprising a base portion and a plurality of protrusions extending from the base, wherein the protrusions contact the adhesive layer;
- removing the liner from the adhesive layer;

adhering the adhesive layer to a support pad;

frictionally contacting at least a portion of the abrasive layer with at least a portion of the surface of the workpiece; and moving at least one of the abrasive article or the workpiece relative to the other to abrade at least a portion of the surface.

In another aspect, the present invention provides method of abrading a workpiece comprising:

providing a nonwoven abrasive article comprising:

a backing having a first major surface and a second major surface opposite the first major surface;

a nonwoven abrasive web on at least a portion of the first major surface, the nonwoven abrasive web comprising an open lofty fiber web, binder, and abrasive particles;

an adhesive layer on at least a portion of the second major surface; and a removable liner adhered to the adhesive layer, the liner comprising a base portion and a plurality of protrusions extending from the base, wherein the protrusions contact the adhesive layer;

removing the liner from the adhesive layer;

adhering the adhesive layer to a support pad;

frictionally contacting at least a portion of the nonwoven abrasive web with at least a portion of the surface of the workpiece; and moving at least one of the abrasive article or the workpiece relative to the other to abrade at least a portion of the surface.

Typically, liners of coated abrasive articles and nonwoven abrasive articles according to the present invention are easily removable and address the problem of inadvertent cutting of the liner during converting operations.

DETAILED DESCRIPTION

Abrasive articles according to the present invention include coated abrasive and nonwoven abrasive articles.

Coated Abrasive Articles

Coated abrasive articles generally include a backing and an abrasive layer comprising abrasive particles, and at least one binder to secure the abrasive particles to the backing. The abrasive layer can be, for example, a single layer (e.g., a slurry layer) or multiple layers (e.g., make and size layers).

Figure 1:
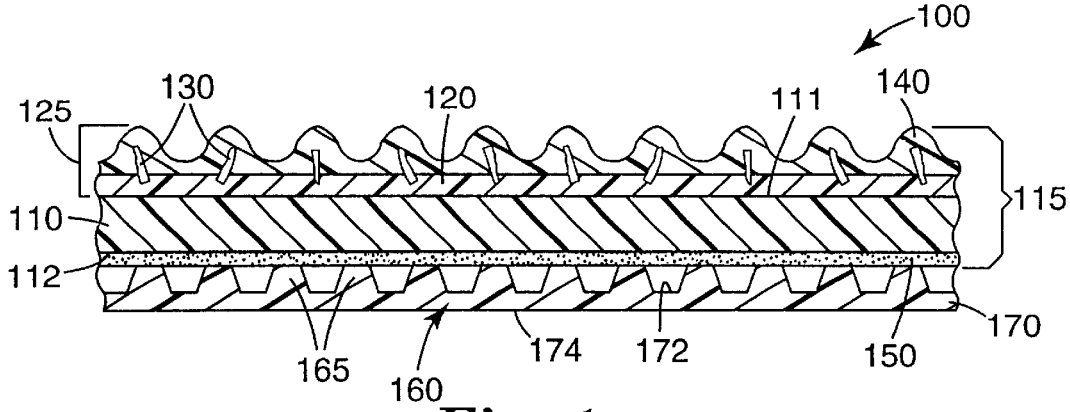
FIG. 1 is a schematic cross-sectional view of one embodiment of a coated abrasive article according to the present invention.

One embodiment of an exemplary coated abrasive article according to the present invention is illustrated in FIG. 1. Referring to this figure, coated abrasive article 100 includes backing 110 having first major surface 111 and second major surface 112 opposite first major surface 111. Abrasive layer 125 is affixed to first major surface 111, and includes abrasive particles 130, make layer 120, and size layer 140. Adhesive layer 150 contacts at least a portion of second major surface 112. For simplicity, backing 110, abrasive layer 125, and adhesive layer 150 are collectively referred to hereinafter as sub-assembly 115. Removable liner 160 includes base portion 170 having first surface 172 and second surface 174 opposite first surface 172. Protrusions 165 extend from first surface 172, and contact adhesive layer 150 such that liner 160 is adhered to adhesive layer 150.

Make and size layers and methods for applying them are well known in the abrasive art. They typically comprise one or more binders (e.g., phenolic, urea-formaldehyde, epoxy, epoxy/acrylate), and serve to bond the abrasive particles to the backing. The make coat may also serve to seal the backing.

Figure 2:
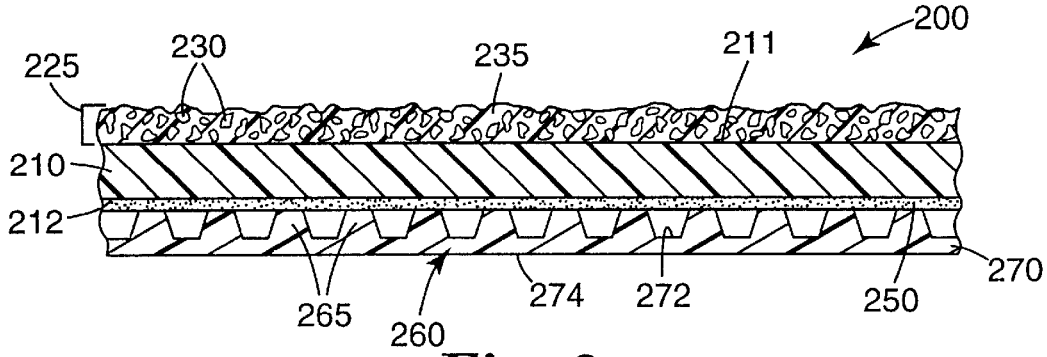
FIG. 2 is a schematic cross-sectional view of another embodiment of a coated abrasive article according to the present invention.

Another embodiment of an exemplary coated abrasive article according to the present invention is illustrated in FIG. 2. Referring to this figure, coated abrasive article 200 includes backing 210 having first major surface 211 and second major surface 212 opposite first major surface 211. Abrasive layer 225 is affixed to first major surface 211 and includes abrasive particles 230 and binder 235. Adhesive layer 250 contacts at least a portion of second major surface 212. Removable liner 260 includes base portion 270 having first surface 272 and second surface 274 opposite first surface 272. Protrusions 265 extend from first surface 272, and contact adhesive layer 250 such that liner 260 is adhered to adhesive layer 250.

The abrasive layer may be applied as a slurry of abrasive particles in a binder precursor that is subsequently cured to form the binder. Such slurries of abrasive particles in a binder precursor and techniques for applying them are well known in the abrasive art.

Suitable backings include those known in the art for making coated or nonwoven abrasive articles, including conventional sealed coated abrasive backings and porous non-sealed backings. The backing may be flexible or rigid. Preferably the backing is flexible. The backing may be made of any number of various materials including those conventionally used as backings in the manufacture of coated abrasives.

Exemplary flexible backings include polymeric film (including primed film) such as polyolefin film (e.g., polypropylene including biaxially oriented polypropylene, polyester film, polyamide film, cellulose ester film), fibrous reinforced thermoplastic, metal foil, mesh, foam (e.g., natural sponge material or polyurethane foam), cloth (e.g., cloth made from fibers or yarns comprising polyester, nylon, silk, cotton, and/or rayon), paper, coated paper, vulcanized paper, vulcanized fiber, nonwoven material, combinations thereof, and treated versions thereof. The backing may also be a laminate of two materials (e.g., paper/film, cloth/paper, nonwoven material/paper, film/cloth). Cloth backings may be woven or stitch bonded. The choice of backing material may depend, for example, on the intended application of the abrasive article.

The thickness of the backing generally ranges from about 0.02 mm to about 5 mm, preferably from about 0.05 mm to about 3.5 mm, and more preferably from about 0.1 mm to about 2 mm, although thicknesses outside of these ranges may also be useful.

An antistatic material may be included in any of these backing treatments. The addition of an antistatic material can reduce the tendency of the abrasive article to accumulate static electricity when sanding wood or wood-like materials.

Suitable abrasive particles include any abrasive particles known in the abrasive art. Exemplary useful abrasive particles include fused aluminum oxide based materials such as aluminum oxide, ceramic aluminum oxide (which may include one or more metal oxide modifiers and/or seeding or nucleating agents), and heat-treated aluminum oxide, silicon carbide, co-fused alumina-zirconia, diamond, ceria, titanium diboride, cubic boron nitride, boron carbide, garnet, flint, emery, sol-gel derived abrasive particles, and blends thereof. Preferably, the abrasive particles comprise fused aluminum oxide, heat-treated aluminum oxide, ceramic aluminum oxide, silicon carbide, alumina zirconia, garnet, diamond, cubic boron nitride, sol-gel derived abrasive particles, or mixtures thereof.

The abrasive particles may be in the form of, for example, individual particles, abrasive composite particles, agglomerates (including erodible agglomerates), and mixtures thereof (e.g., having the same or different size(s) and/or composition(s)).

The abrasive particles typically have an average diameter of from about 0.1 micrometers to about 2000 micrometers, more preferably from about 1 micrometers to about 1300 micrometers, although other particles having other diameters can be used.

Coating weights for the abrasive particles may depend on, for example, the type of abrasive article (e.g., coated abrasive article or nonwoven abrasive article), the process for applying the abrasive particles, and the size of the abrasive particles, but typically range from about 5 grams per square meter ($g/m^2$) to about 1350 $g/m^2$.

Abrasive articles according to the present invention typically include at least one binder (e.g., in make, size, and/or slurry layers of coated abrasive articles, or coated on a fiber web of nonwoven abrasive articles). Typically, binder(s) is formed by curing (e.g., by thermal means, or by using electromagnetic or particulate radiation) binder precursor(s). Useful binders and binder precursors may be inorganic or organic. Useful binder precursors include thermally curable resins and radiation curable resins, which may be cured, for example, thermally and/or by exposure to radiation. Exemplary organic binder precursors include glue, phenolic resin, aminoplast resin, urea-formaldehyde resin, melamine-formaldehyde resin, urethane resin, (e.g., an aminoplast resin having pendant $\alpha,\beta$-unsaturated groups, acrylated urethane, acrylated epoxy, acrylated isocyanurate), acrylic resin, epoxy resin (including bis-maleimide and fluorene-modified epoxy resins), isocyanurate resin, as well as mixtures thereof.

The binder and/or abrasive product may also include additives such as fibers, lubricants, wetting agents, thixotropic materials, surfactants, pigments, dyes, antistatic agents (e.g., carbon black, vanadium oxide, graphite, etc.), grinding aids, coupling agents (e.g., silanes, titanates, zircoaluminates, etc.), plasticizers, wetting agents, suspending agents, and the like. The amounts of these optional additives are selected to provide the preferred properties. The coupling agents can improve adhesion to the abrasive particles and/or filler.

In some embodiments of coated abrasive articles, according to the present invention, one or more additional optional coatings (e.g., saturant, presize layer, backsize layer, tie layer, supersize layer) may be present as continuous or discontinuous layers as dictated by the function or purpose of the material as known to one skilled in the art. For example, it may be preferable to provide a saturation coat to smooth the inherent textured surface of the paper backing material, particularly if utilizing fine grades of abrasive. A supersize layer, that is, a coating applied on at least a portion of the size layer, can be added to provide, for example, a grinding aid, and/or as an anti-loading coating.

Further, with regard to the optional supersize layer, it may serve to prevent or reduce the accumulation of swarf (the material abraded from a workpiece) between abrasive particles, which can dramatically reduce the cutting ability of the coated abrasive article. Supersize layers preferably may include a grinding aid (e.g., potassium tetrafluoroborate), metal salts of fatty acids (e.g., zinc stearate or calcium stearate), salts of phosphate esters (e.g., potassium behenyl phosphate), phosphate esters, urea-formaldehyde resins, mineral oils, crosslinked silanes, crosslinked silicones, and/or fluorochemicals.

Further description of techniques and materials for making coated abrasive articles may be found in, for example, U.S. Pat. No. 4,314,827 (Leitheiser, et al.); U.S. Pat. No. 4,518,397 (Leitheiser, et al.); U.S. Pat. No. 4,588,419 (Caul, et al.); U.S. Pat. No. 4,623,364 (Cottringer, et al.); 4,652,275 (Bloecher, et al.); U.S. Pat. No. 4,734,104 (Broberg); U.S. Pat. No. 4,737,163 (Larkey); U.S. Pat. No. 4,744,802 (Schwabel); U.S. Pat. No. 4,751,138 (Tumey, et al.); U.S. Pat. No. 4,770,671 (Monroe, et al.); U.S. Pat. No. 4,799,939 (Bloecher, et al.); U.S. Pat. No. 4,881,951 (Wood, et al.); U.S. Pat. No. 4,927,431 (Buchanan, et al.); U.S. Pat. No. 5,498,269 (Larmie); U.S. Pat. No. 5,011,508 (Wald, et al.); U.S. Pat. No. 5,078,753 (Broberg, et al.); U.S. Pat. No. 5,090,968 (Pellow); U.S. Pat. No. 5,108,463 (Buchanan, et al.); U.S. Pat. No. 5,137,542 (Buchanan, et al.); U.S. Pat. No. 5,139,978 (Wood); U.S. Pat. No. 5,152,917 (Pieper, et al.); U.S. Pat. No. 5,201,916 (Berg, et al.); U.S. Pat. No. 5,203,884 (Buchanan, et al.); U.S. Pat. No. 5,227,104 (Bauer); U.S. Pat. No. 5,328,716 (Buchanan); U.S. Pat. No. 5,366,523 (Rowenhorst, et al.); U.S. Pat. No. 5,378,251 (Culler, et al.); U.S. Pat. No. 5,417,726 (Stout, et al.); U.S. Pat. No. 5,429,647 (Larmie); U.S. Pat. No. 5,436,063 (Follett, et al.); U.S. Pat. No. 5,490,878 (Peterson, et al.); U.S. Pat. No. 5,496,386 (Broberg, et al.); U.S. Pat. No. 5,520,711 (Helmin); U.S. Pat. No. 5,549,962 (Holmes, et al.); U.S. Pat. No. 5,551,963 (Larmie); U.S. Pat. No. 5,556,437 (Lee, et al.); U.S. Pat. No. 5,560,753 (Buchanan, et al.); U.S. Pat. No. 5,609,706 (Benedict, et al.); U.S. Pat. No. 5,700,302 (Stoetzel, et al.); U.S. Pat. No. 5,942,015 (Culler, et al.); U.S. Pat. No. 5,954,844 (Law, et al.); U.S. Pat. No. 5,961,674 (Gagliardi, et al.); U.S. Pat. No. 5,975,988 (Christianson); U.S. Pat. No. 6,059,850 (Lise, et al.); and U.S. Pat. No. 6,261,682 (Law), the disclosures of which are incorporated herein by reference.

Nonwoven Abrasive Articles

Figure 3:
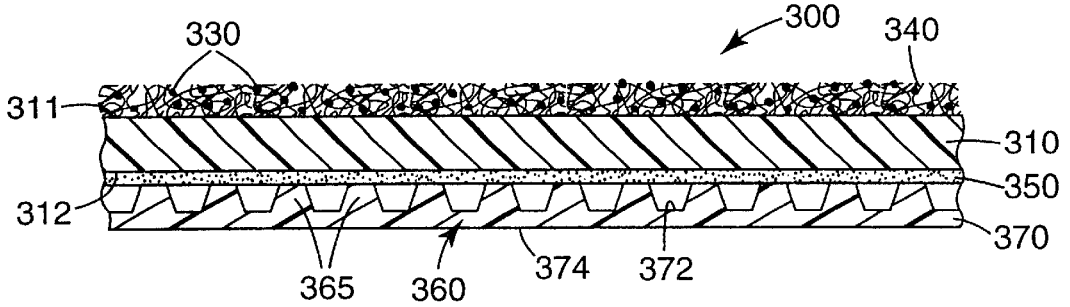
FIG. 3 is a schematic cross-sectional view of one embodiment of a nonwoven abrasive article of the present invention.

A nonwoven abrasive article according to one embodiment according to the present invention is shown in FIG. 3. Nonwoven abrasive article 300 includes open lofty fiber web 340 having abrasive particles 330 distributed throughout fiber web 340 and adherently bonded therein by an organic binder (not shown). Fiber web 340 is affixed to backing 310 which has first major surface 311 and second major surface 312 opposite first major surface 311. At least a portion of second major surface 312 has adhesive layer 350 thereon. Removable liner 360 has a base portion 370 having a first surface 372 and a second surface 374 opposite first surface 372 of base portion 370. Protrusions 365 extend from first surface 372 of liner 360 and contact adhesive layer 350 such that liner 360 is adhered to the adhesive layer.

The fiber web may comprise continuous or staple fibers, preferably crimped and/or entangled with one another. Exemplary fibers include polyester fibers, polyamide fibers, and polyaramid fibers.

The fiber web may be affixed (i.e., secured) to the backing, for example, by needletacking, stitchbonding, and/or adhesive bonding (e.g., using glue or a hot melt adhesive).

Binders and binder precursors, backings, abrasive particles, optional additives, and optional layers set forth hereinabove for inclusion in coated abrasive articles may also be utilized in nonwoven abrasives according to the present invention.

Further description of techniques and materials for making nonwoven abrasive articles may be found in, for example, U.S. Pat. No. 2,958,593 (Hoover, et al.); U.S. Pat. No. 4,331,453 (Dau, et al.); U.S. Pat. No. 4,991,362 (Heyer, et al.); U.S. Pat. No. 5,591,239 (Edblom, et al.); U.S. Pat. No. 5,681,361 (Saunders); U.S. Pat. No. 5,858,140 (Berger, et al.); U.S. Pat. No. 6,017,831 (Beardsley, et al.); and U.S. Pat. No. 6,207,246 (Moren, et al.), the disclosures of which are incorporated herein by reference.

Coated and nonwoven abrasive articles according to the present invention include an adhesive layer, typically in contact with the backing, to which a removable liner is adhered.

Examples of adhesives for the adhesive layer include those known in the art, including hot melt adhesives, tacky adhesives (including pressure-sensitive adhesives), and/or curable adhesives. Preferably the adhesive layer is tacky. More preferably, the adhesive layer is a pressure-sensitive adhesive.

Pressure-sensitive adhesives are generally described in, for example, "Handbook of Pressure-Sensitive Adhesive Technology", 3rd Ed., D. Satas, Ed., Von Nostrand Reinhold (1989). Exemplary pressure-sensitive adhesives include latex crepe, rosin, acrylic polymers and copolymers including polyacrylate esters (e.g., poly(butyl acrylate)) polyvinyl ethers (e.g., poly(vinyl n-butyl ether)), poly(alpha-olefins), silicones, alkyd adhesives, rubber adhesives (e.g., natural rubber, synthetic rubber, chlorinated rubber), and mixtures thereof.

Adhesive may be applied to the backing, for example, as a pure material, as a solution in a solvent, or as an aqueous dispersion. Methods for applying adhesive to the backing are widely known, and include spraying, curtain coating, roll coating, screen printing, hot melt extrusion coating, knife coating, and the like.

The adhesive layer may be of any weight or thickness. Preferably, the adhesive layer has a coated thickness in a range of from about 1 micrometer to about 220 micrometers, more preferably in a range of from about 5 micrometers to about 170 micrometers. The adhesive layer may be continuous or discontinuous.

Abrasive articles according to the present invention typically include a removable liner adhered to the adhesive layer on the backing. The liner serves, at least in part, to protect the adhesive layer from accidental adhesion to, or contamination by, various objects such as dust, fingers, or other abrasive articles (e.g., if stacked).

Preferably, the liner is flexible. As used herein, the term "flexible" as applied to the liner means that the liner can be folded flat onto itself and unfolded, at least once, without breaking or cracking.

Preferably the liner is disposable, and can be discarded without detriment to the performance of the abrasive article.

With appropriate treatment (e.g., embossing), the liner can be produced from virtually any material known for use as a liner, but preferably the liner comprises an extrudable thermoplastic resin. Exemplary extrudable thermoplastic resins include, for example, polyesters such as poly(ethylene terephthalate), polyolefins (e.g., polypropylene, polybutylene, copolymers of polypropylene and ethylene, or polyethylene), polystyrenes (e.g., poly(styrene-co-acrylonitrile) and poly(acrylonitrile-co-butadiene-co-styrene)), plasticized polyvinyl chloride, polycarbonates, and polymethacrylates. Preferably, the extrudable thermoplastic comprises a polyolefin, more preferably the extrudable thermoplastic comprises polypropylene, polyethylene, and/or a copolymer of propylene and ethylene.

Typically, the liner has protrusions resulting in a textured surface. The protrusions may be disconnected or connected (e.g., ridges and posts connected to form a square grid pattern). The protrusions may be regularly or irregularly spaced apart, preferably the protrusions are regularly spaced apart. The protrusions contact the adhesive layer, and may penetrate into the adhesive layer, optionally to a degree sufficient to contact the backing.

Preferably, opposing sides of individual protrusions are substantially parallel or narrow toward the tips of the protrusions. The protrusions may be of any combination of sizes and/or shapes depending on the preferred interaction between the liner and the specific abrasive article. Exemplary shapes of individual protrusions include posts (e.g., cylindrical, prismatic), cones, hemispheres, pyramids (including truncated pyramids), ridges, although other shapes are also useful. Preferably, the tips of individual protrusions are substantially planar, but they can be concave, convex, and/or combinations thereof. Preferably, the tips of the protrusions terminate in substantially the same plane, although this is not a requirement.

The cross-sectional shape of protrusions may be any shape that affords the preferred release characteristics. Typically, the cross-sectional shape of protrusions is determined by the manufacturing method employed to make them. Exemplary cross-sectional shapes of individual protrusions (determined at the midpoint between the tip of the protrusion and the base portion of the liner) include circles, ellipses, polygons, and combinations thereof. Useful polygonal cross-sectional shapes include squares, triangles, rectangles, and trapezoids, for example. Protrusions with a circular cross-sectional shape are particularly preferable. The protrusions may be interconnected, forming a raised connected pattern, preferably having substantially uniform height. Exemplary raised connected patterns include a square grid, a hexagonal grid, a diamond grid, a rectangular grid, and a triangular grid.

By way of illustration, FIGS. 4–7 show exemplary liners useful in practice of the present invention.

Figure 4:
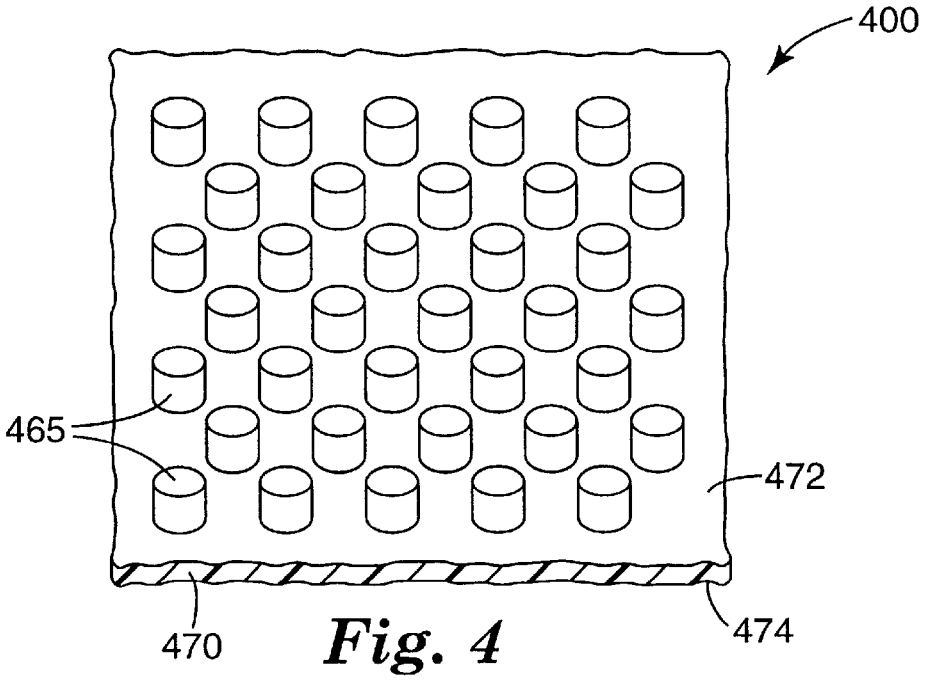
FIGS. 4–7 are perspective views of exemplary embodiments of a liner as illustrated in FIGS. 1–3.

Referring now to FIG. 4, liner 400 includes base portion 470 having first surface 472 and second surface 474 opposite the first surface. Cylindrically shaped protrusions 465 extend from first surface 472.

Figure 5:
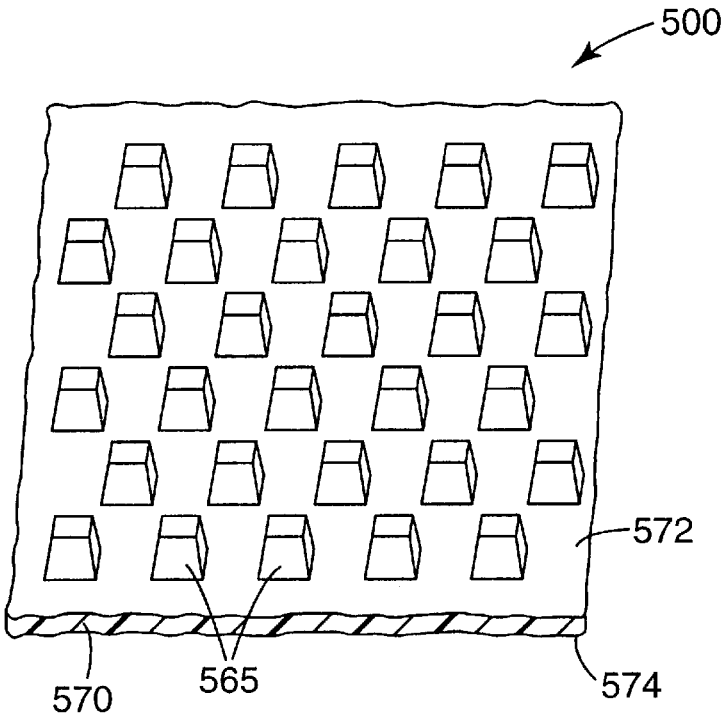

Referring now to FIG. 5, liner 500 includes base portion 570 having first surface 572 and second surface 574 opposite first surface 572. Truncated pyramidally shaped protrusions 565 extend from first surface 572.

Figure 6:
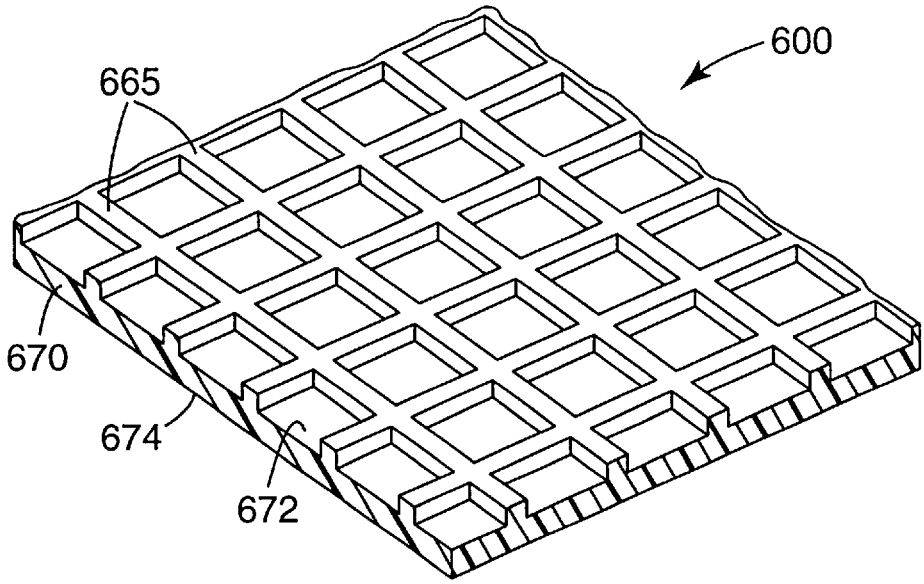

Referring now to FIG. 6, liner 600 includes base portion 670 having first surface 672 and second surface 674 opposite first surface 672. Interconnected protrusions 665 extend from first surface 672 and collectively form a raised square grid pattern.

Figure 7:
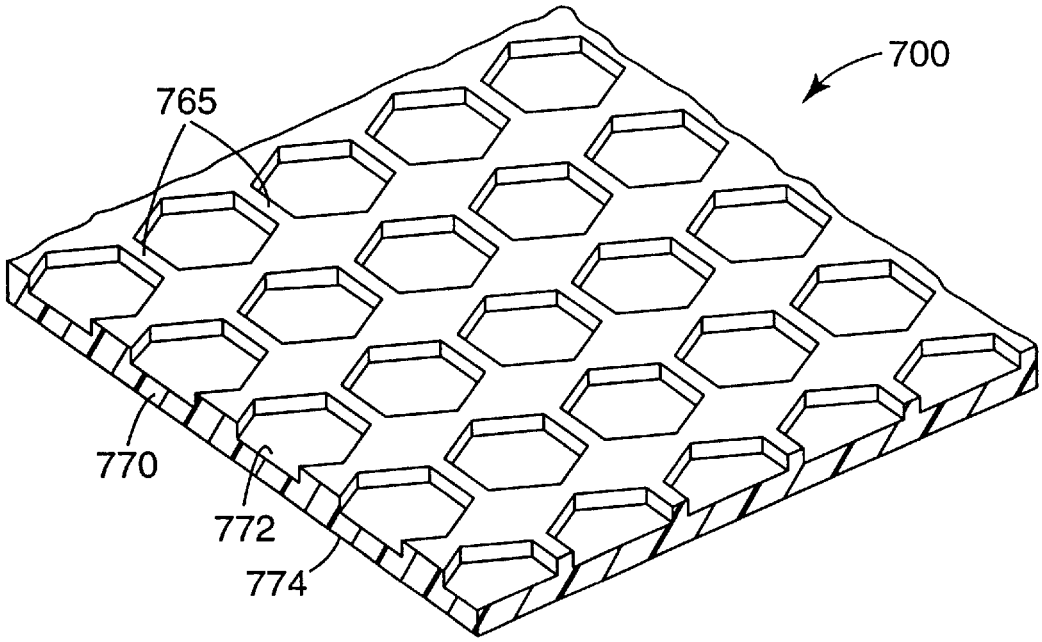

Referring now to FIG. 7, liner 700 includes base portion 770 having a first surface 772 and second surface 774 opposite first surface 772. Interconnected protrusions 765 extend from first surface 772 and collectively form a raised hexagonal grid pattern.

The protrusions may be conveniently formed by a variety of methods including embossing, or melt extrusion into a mold (e.g., a patterned roll). Methods of forming protrusions are described, for example, in U.S. Patent Publication Nos. 20010036529 (Calhoun, et al.), published Nov. 1, 2001, and 20020037393 (Strobel, et al.), published Mar. 28, 2002, and PCT Publications WO 97/13633 A 1 (Calhoun, et al.), published Apr. 17, 1997, and WO 00/73082 A 1 (Engle, et al.), published Dec. 7, 2000, the disclosures of which are incorporated herein by reference.

Embossing can be achieved, for example, by passing a thermoplastic film through a roll nip to compress against a tool having a corresponding embossed pattern.

Protrusions can also be formed, for example, by casting a molten thermoplastic using a tool having an embossed or recessed pattern, solidifying the thermoplastic, and removing the resulting textured solid film as described, for example, in U.S. Pat. No. 5,845,375 (Bychinski, et al.), the disclosure of which is incorporated herein by reference. For example, using a tool having a pattern of cylindrical cavities will result in formation of a liner having protruding cylindrical posts in a corresponding pattern. In such a process, the depth of the cavity is preferably chosen to be at least about twice the depth of the intended height of the cylindrical posts.

The density of protrusions on the first surface of liner (i.e., number of protrusions per unit area) may be any number that affords the preferred release characteristics. Preferably, the density of protrusions on the first surface of the liner is such that the adhesive layer is not able to sag in between protrusions and touch the base portion of the liner. For example, the density of protrusions on the first surface of the liner may be in a range of from about 10 to about 250 protrusions per square centimeter of the liner, preferably in a range of from about 15 to about 186 protrusions per square centimeter, more preferably in a range of from about 31 to about 62 protrusions per square centimeter.

Preferably, the physical dimensions of the protrusions are such that when compressive stress is applied, the protrusions do not bend or buckle and maintain their structural integrity to prevent the adhesive layer from contacting the land area of the base portion of the liner.

Typically, the height of the protrusions is selected such that it is greater than the thickness of the adhesive layer so that under compressive load the protrusion tips can penetrate the adhesive layer and contact the backing layer without the near adhesive surface contacting the base portion of the liner. Preferably, the height of at least some of the protrusions is at least about 0.025 mm, more preferably at least about 0.10 mm greater than the thickness of the adhesive layer. The protrusions may be of the same or different heights. In some embodiments, the protrusions are preferably of substantially the same height, allowing for process variations. Preferably, the average height of the protrusions is in a range of from about 0.12 mm to about 1.0 mm, more preferably from about 0.25 mm to about 0.64 mm, and more preferably from about 0.38 mm to about 0.50 mm. Depending on the nature of the abrasive article, the height of the protrusions is typically selected such that easy separation of the liner from the adhesive layer is possible.

Typically, protrusions preferably have a width or diameter in a range of from about 0.15 mm to about 0.76 mm, although other widths and diameters may be used. Preferably, with increasing protrusion height the width and/or diameter of the protrusions is increased to prevent bending or buckling of the protrusions. Preferably, protrusions according to the present invention include those with an aspect ratio (i.e., ratio of protrusion height to width at the base) of about 2:1 or less, preferably about 1:1 or less.

A second surface of the liner that is opposite the first surface having protrusions thereon can remain unmodified or can also be embossed as described above for the first surface.

The thickness of the liner base portion can be any thickness that imparts the preferred processing characteristics, flexural stiffness, tear resistance, and tensile strength. Preferably, the liner base portion has a thickness in a range of from about 0.025 mm to about 0.25 mm, more preferably in a range of from about 0.076 mm to about 0.13 mm.

Abrasive articles according to the present invention can be converted into forms, shapes, and/or sizes including, for example, rolls, discs (including perforated discs), and/or sheets by a wide variety of methods including, for example, die cutting, knife cutting, and laser cutting.

In some embodiments, coated abrasive articles according to the present invention may be converted into coated abrasive discs having a major portion and a tab to aid in removal of the liner. In such embodiments, as viewed perpendicularly to the backing, the major portion of the coated abrasive and/or the tab may be of any shape; for example, a circle, a crescent, an ellipse, or a polygon (e.g., a square, a triangle, a rectangle, a hexagon, or a trapezoid). Preferably, the major portion has a rotational axis of symmetry perpendicular to first major surface of the backing. Preferably, as viewed perpendicularly to the backing, the major portion has a circular shape, and the tab has a crescent shape.

Figure 8:
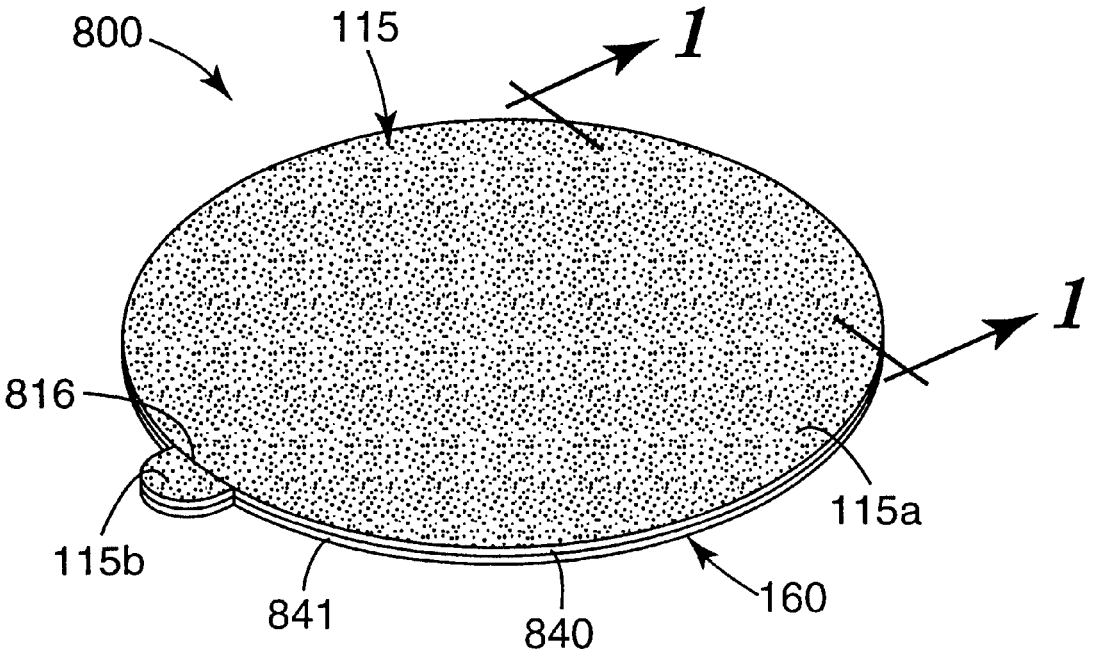
FIG. 8 is a perspective view of one embodiment of a coated abrasive article, as illustrated in FIG. 1, having a tab.

Referring now to FIG. 8, coated abrasive disc 800 is an exemplary such embodiment of coated abrasive article 100. In FIG. 8, sub-assembly 115 has a perimeter 840 that is substantially coterminous with perimeter 841 of liner 160. Sub-assembly 115 comprises a major portion 115*a* and a tab 115*b*, which are separated by cut 816 that dissects sub-assembly 115, but does not extend through liner 160.

Prior to abrading a workpiece, tab 115*b* can be grasped, and the coated abrasive disc 800 flexed along cut 816 to facilitate separation of the liner 160 from the major portion 115*a* of sub-assembly 115, which, for example, may then be adhered to a support pad. Cut 816 may be formed, for example, by any cutting method, preferably by die cutting or laser cutting. If forming cut 816 by die cutting, the die is typically positioned such that the die cuts through the backing, but does not penetrate or sever base portion 170 of liner 110.

Abrasive articles according to the present invention are useful for abrading a workpiece. During use, the liner is typically removed from the abrasive article thereby exposing the adhesive layer, which is then brought into adhesive contact with a support pad (also known in the art as a backup pad). Exemplary support pads are described, for example, in U.S. Pat. No. 5,807,161 (Manor, et al.) and U.S. Pat. No. 4,631,220 (Clifton), the disclosures of which are incorporated herein by reference. The support pad may, optionally, have a mounting shaft attached thereto as described in U.S. Pat. No. 6,142,858 (Luedeke), the disclosure of which is incorporated herein by reference.

After mounting the abrasive article on the support pad, the abrasive article is brought into frictional contact with a surface of the workpiece. At least one of the abrasive article or the workpiece is then moved relative to the other to abrade at least a portion of the surface. Examples of workpiece materials include metal, metal alloys, exotic metal alloys, ceramics, glass, wood, wood-like materials, composites, painted surfaces, plastics, reinforced plastics, stone, and/or combinations thereof. The workpiece may be flat or have a shape or contour associated with it. Exemplary workpieces include metal components, plastic components, particleboard, camshafts, crankshafts, furniture, and turbine blades.

Abrasive articles according to the present invention may be used by hand and/or used in combination with a machine.

At least one or both of the abrasive article and the workpiece is moved relative to the other when abrading.

In another aspect, abrading may be conducted under wet or dry conditions. Exemplary liquids for wet abrading include water, water containing conventional rust inhibiting compounds, lubricant, oil, soap, and cutting fluid. The liquid may also contain defoamers, degreasers, and/or the like.

The present invention will be more fully understood with reference to the following non-limiting examples in which all parts, percentages, ratios, and so forth, are by weight unless otherwise indicated.

EXAMPLES

Unless otherwise noted, all reagents used in the examples were obtained, or are available from, general chemical suppliers such as Aldrich Chemical Co., Milwaukee, Wis., or may be synthesized by known methods.

The following abbreviations are used throughout the following examples: cm=centimeter, kPa=kilopascals, mm=millimeter, and psi=pounds per square inch.

Preparation of Liners 1–7

Liner 1

Ethylene-propylene impact copolymer resin (obtained under the trade designation "SRD7-587 DEVELOPMENTAL POLYPROPYLENE RESIN" from Dow Chemical Company, Midland, Mich.) was extruded using a single screw extruder (obtained from Merritt Davis Corp., Hamden, Conn.) at a temperature of 210° C. into the cavities of a mild steel patterned roll maintained at a temperature of 21° C. while continuously rotating the patterned roll at a surface speed of 33 meters per minute and using a nominal nip pressure of 3 psi (20 kPa). The surface of the patterned roll had a hexagonal close packed array of cylindrical cavities, with a center-to-center nominal spacing of 1.44 mm (i.e., a density of 50 cylindrical cavities per square centimeter). Each cavity had a nominal diameter of 0.45 mm and a nominal depth of 1.52 mm.

In a continuous process, the resin was pressed into the cavities by a roller along the surface of the patterned roll adjacent where the resin was extruded onto the patterned roll and spaced from that surface so that the thickness of the layer of resin overlying the cavities and the surface of the patterned roll was 0.13 mm. The solidified resin was stripped from the patterned roll as a liner having a hexagonal close packed array of upstanding cylindrical protrusions of 0.15 mm nominal height and a nominal center-to-center spacing of 1.44 mm. The liner was wound onto a take up roll. The base portion of the liner had a nominal thickness of 0.13 mm.

Liner 2

The procedure for making Liner 1 was repeated, except that a nip pressure of approximately 7.5 psi (52 kPa) was used, resulting in a liner having cylindrical protrusions of 0.25 mm nominal height.

Liner 3

The procedure for making Liner 1 was repeated, except that a nip pressure of approximately 13 psi (90 kPa) was used, resulting in a liner having cylindrical protrusions of 0.36 mm nominal height.

Liner 4

The procedure for making Liner 1 was repeated, except that a nip pressure approximately 22 psi (150 kPa) was used, resulting in a liner having cylindrical protrusions of 0.46 mm nominal height.

Liner 5

The procedure for making Liner 1 was repeated, except that a nip pressure of approximately 28 psi (190 kPa) was used, resulting in a liner having cylindrical protrusions of 0.56 mm nominal height.

Liner 6

The procedure for making Liner 1 was repeated, except that a nip pressure of approximately 30 psi (210 kPa) was used, resulting in a liner having cylindrical protrusions of 0.61 mm nominal height.

Liner 7

The procedure for making Liner 1 was repeated, except that a nip pressure of approximately 32 psi (220 kPa) was used, resulting in a liner having cylindrical protrusions of 0.66 mm nominal height.

COMPARATIVE EXAMPLE A

Three 6-inch (15 cm) diameter pressure-sensitive adhesive (PSA) backed C-weight coated abrasive discs, each having a silicone coated paper release liner, available under the trade designation "STIKIT 233U P150", were obtained from 3M Company, St. Paul, Minn. A 5-inch (12.7 cm) diameter disc, having a tab (0.38 inch (9.7 mm) radius) protruding 0.38 inch (9.7 mm) beyond the disc perimeter, was die-cut from each coated abrasive disc using a hydraulic press obtained under the trade designation "SAMCO MODEL SB-25" from Deutsche Vereingte Schuhmaschinen GmbH, Frankfurt am Main, Germany. The die used consisted of a 5-inch (12.7 cm) diameter circular blade having an arc of 0.38 inch (9.7 mm) radius protruding 0.38 inch (9.7 mm) therefrom to form a tab. The portion of the blade on the circumference of the disc, and separating the tab from the disc (to form a cut as generally illustrated in FIG. 8), was recessed 5 mils (0.13 mm) relative to the remainder of the cutting surfaces of the die. Under die cutting conditions just sufficient to cut the outline of the three abrasive discs, the cut separating the disc portion from the tab portion of each coated abrasive article from the disc extended into the paper liner, partially or completely removing the tab.

COMPARATIVE EXAMPLE B

Comparative Example A was repeated, except the 6-inch (15 cm) diameter PSA backed C-weight abrasive discs were replaced with 6-inch (15 cm) diameter PSA backed D-weight coated abrasive discs having a silicone coated paper release liner, available under the trade designation "STIKIT 243U P80", obtained from 3M Company. Under die cutting conditions just sufficient to cut the outline of the three abrasive discs, the cut separating the disc portion from the tab portion of each coated abrasive article from the disc extended into the paper liner, partially or completely removing the tab.

EXAMPLE 1

The paper liner was removed from three 6-inch (15 cm) diameter PSA backed C-weight "STIKIT 233U P150" coated abrasive discs. A section of Liner 3 (8 inches×8 inches (20.3 cm×20.3 cm)) was manually laminated to the PSA layer of each abrasive disc. Three 5-inch (12.7 cm) diameter discs, each having a tab (0.38 inch (9.7 mm) radius) protruding 0.38 in (9.7 mm) from the perimeter of the disc, were die-cut as described in Comparative Example A, resulting in three coated abrasive discs having an attached tab separated from the coated abrasive disc by a cut that did not noticeably penetrate into the base portion of the liner.

EXAMPLE 2

The procedure of Example 1 was repeated, except that the 6-inch (15 cm) diameter PSA backed C-weight coated abrasive disc was replaced with a 6-inch (15 cm) diameter PSA backed D-weight coated abrasive disc obtained from 3M Company under the trade designation "STIKIT 243U P80". The resulting coated abrasive discs each had a tab separated from the coated abrasive disc by a cut that did not noticeably penetrate into the base portion of the liner.

EXAMPLE 3

The procedure of Example 1 was repeated, except that the liner from Example 1 was replaced by Liner 4. The resulting coated abrasive discs each had a tab separated from the coated abrasive disc by a cut that did not noticeably penetrate into the base portion of the liner.

EXAMPLE 4

The procedure of Example 3 was repeated, except that the 6-inch (15 cm) diameter PSA backed C-weight coated abrasive disc was replaced with a 6-inch (15 cm) diameter PSA backed D-weight "STIKIT 243U P80" coated abrasive disc. The resulting coated abrasive discs each had a tab separated from the coated abrasive disc by a cut that did not noticeably penetrate into the base portion of the liner.

EXAMPLE 5

The procedure of Example 3 was repeated, except that Liner 3 was replaced by Liner 5. The resulting coated abrasive discs each had a tab separated from the coated abrasive disc by a cut that did not noticeably penetrate into the base portion of the liner.

EXAMPLE 6

The procedure of Example 5 was repeated, except that the 6-inch (15 cm) diameter PSA backed C-weight coated abrasive disc was replaced with a 6-inch (15 cm) diameter PSA backed D-weight "STIKIT 243U P80" disc. The resulting coated abrasive discs each had a tab separated from the coated abrasive disc by a cut that did not noticeably penetrate into the base portion of the liner.

Similarly, it is also possible to use any of Liners 1, 2, 6, or 7 to make abrasive articles of the present invention. This may be accomplished, for example, according to the procedure of any of Examples 1–6, but substituting any one of Liners 1, 2, 6, or 7 for the liner that was used in the specific Example.

During the course of preparing Examples 1–6 and Comparative Examples A and B, it was also observed that, without using the tab portion, it was significantly more difficult to initiate separation by hand of coated abrasive discs from the paper liners of Comparative Examples A and B than from the liners of Examples 1–6.

Various modifications and alterations of this invention will become apparent to those skilled in the art without departing from the scope and spirit of this invention, and it should be understood that this invention is not to be unduly limited to the illustrated embodiments set forth herein.

What is claimed is:

1. A coated abrasive article comprising:

a backing having a first major surface and a second major surface opposite the first major surface;

an abrasive layer on at least a portion of the first major surface, wherein the abrasive layer comprises binder and abrasive particles;

an adhesive layer on at least a portion of the second major surface; and a removable liner adhered to the adhesive layer, the liner comprising a base portion having protrusions extending therefrom, wherein at least some of the protrusions contact the adhesive layer.

2. A coated abrasive article according to claim 1, wherein the base portion has a first surface, and wherein the protrusions extend from the first surface.

3. A coated abrasive article according to claim 1, wherein the adhesive layer does not contact the base portion of the liner.

4. A coated abrasive article according to claim 1, wherein the backing comprises at least one of cloth, paper, foam, or thermoplastic film.

5. A coated abrasive article according to claim 1, wherein the adhesive layer comprises a pressure-sensitive adhesive.

6. A coated abrasive article of claim 5, wherein the pressure-sensitive adhesive is selected from the group consisting of natural rubber, synthetic rubber, block copolymers, poly(meth)acrylates, silicones, polyolefins, and combinations thereof.

7. A coated abrasive article according to claim 1, wherein the liner comprises a thermoplastic.

8. A coated abrasive article of claim 7, wherein the thermoplastic is selected from the group consisting of polyolefins, polyesters, polycarbonates, and poly(meth) acrylates.

9. A coated abrasive article of claim 7, wherein the thermoplastic comprises at least one of polyethylene or polypropylene.

10. A coated abrasive article according to claim 1, wherein at least some of the protrusions have a rotational axis of symmetry perpendicular to the first major surface.

11. A coated abrasive article according to claim 1, wherein the protrusions comprise cylindrical posts.

12. A coated abrasive article according to claim 1, wherein the protrusions comprise ridges.

13. A coated abrasive article according to claim 1, wherein the average density of protrusions is in a range of from about 15 to about 186 protrusions per square centimeter.

14. A coated abrasive article according to claim 1, wherein the average density of protrusions is in a range of from about 31 to about 62 protrusions per square centimeter.

15. A coated abrasive article according to claim 1, wherein the protrusions have an average height in a range of from about 0.12 to about 0.64 mm.

16. A coated abrasive article according to claim 1, wherein the protrusions have an average height in a range of from about 0.38 to about 0.50 mm.

17. A coated abrasive article according to claim 1, wherein the average height of the protrusions is at least about 0.025 mm greater than the average thickness of the adhesive layer.

18. A coated abrasive article according to claim 1, wherein the average height of the protrusions is at least about 0.10 mm greater than the average thickness of the adhesive layer.

19. A coated abrasive article according to claim 1, wherein the abrasive layer comprises a make layer and a size layer.

20. A coated abrasive article according to claim 1, wherein the abrasive layer comprises a slurry layer.

21. A coated abrasive, article according to claim 1, wherein the abrasive article further comprises at least one of a backsize layer, supersize layer, presize layer, or saturant.

22. A coated abrasive article according to claim 1, wherein the perimeter of the liner extends beyond the perimeter of the backing.

23. A coated abrasive article according to claim 1, wherein the perimeter of the backing and the perimeter of the liner are substantially coterminous.

24. A coated abrasive article according to claim 23, wherein the backing comprises first and second adjacent discrete portions.

25. A coated abrasive article according to claim 24, wherein the first and second adjacent portions are separated by a cut.

26. A coated abrasive article according to claim 25, wherein the first portion of the backing has a shape with a rotational axis of symmetry perpendicular to the first major surface.

27. A coated abrasive article according to claim 25, wherein the first portion of the backing comprises a shape selected from the group consisting of a circle or a polygon and wherein the second portion, as adhered to the liner, comprises a flexible tab.

28. A nonwoven abrasive article comprising:

a backing having a first major surface and a second major surface opposite the first major surface;

a nonwoven abrasive web on at least a portion of the first major surface, the nonwoven abrasive web comprising an open lofty fiber web, binder, and abrasive particles;

an adhesive layer on at least a portion of the second major surface; and a removable liner adhered to the adhesive layer, the liner comprising a base portion having protrusions extending therefrom, wherein at least some of the protrusions contact the adhesive layer.

29. A nonwoven abrasive article according to claim 28, wherein the base portion has a first surface, and wherein the protrusions extend from the first surface.

30. A nonwoven abrasive article according to claim 28, wherein the adhesive layer does not contact the base portion of the first surface of the liner.

31. A nonwoven abrasive article according to claim 28, wherein the adhesive layer comprises a pressure-sensitive adhesive.

32. A nonwoven abrasive article according to claim 28, wherein the liner comprises a thermoplastic.

33. A nonwoven abrasive article according to claim 28, wherein the perimeter of the liner extends beyond the perimeter of the backing.

34. A nonwoven abrasive article according to claim 28, wherein the perimeter of the backing and the perimeter of the liner are substantially coterminous.

35. A nonwoven abrasive article according to claim 28, wherein the backing comprises first and second adjacent discrete portions.

36. A nonwoven abrasive article according to claim 35, wherein the first and second adjacent portions are separated by a cut.

37. A nonwoven abrasive article according to claim 36, wherein the first portion of the backing has a shape with a rotational axis of symmetry perpendicular to the first major surface.

38. A nonwoven abrasive article according to claim 36, wherein the first portion of the backing comprises a shape selected from the group consisting of a circle or a polygon and wherein the second portion, as adhered to the liner, comprises a flexible tab.

39. A method of making a coated abrasive article comprising:

providing a backing having a first major surface and a second major surface opposite the first major surface;

affixing an abrasive layer to at least a portion of the first major surface, the abrasive layer comprising a binder and abrasive particles;

affixing an adhesive layer to at least a portion of the second major surface; and adhering a removable liner to the adhesive layer, the liner comprising a base portion and a plurality of protrusions extending from the base, by contacting the protrusions with the adhesive layer.

40. A method of making a coated abrasive article according to claim 39, wherein the adhesive layer does not contact the base portion of the first surface of the liner.

41. A method of making a coated abrasive article according to claim 39, wherein the abrasive layer comprises a make layer and a size layer.

42. A method of making a coated abrasive article according to claim 39, wherein the abrasive layer comprises a slurry layer.

43. A method of making a coated abrasive article according to claim 39, further comprising severing the backing without severing the liner.

44. A method of making a coated abrasive article according to claim 39, further comprising, as a single step, cutting the abrasive layer and the backing without cutting the liner.

45. A method of making a nonwoven abrasive article comprising:

providing a backing having a first major surface and a second major surface opposite the first major surface;

affixing a nonwoven abrasive web to at least a portion of the first major surface, the nonwoven abrasive web comprising an open lofty fiber web, binder, and abrasive particles;

affixing an adhesive layer to at least a portion of the second major surface; and adhering a removable liner to the adhesive layer, the liner comprising a first surface having a base portion and a plurality of protrusions, wherein the protrusions contact the adhesive layer.

46. A method of abrading a workpiece comprising:

providing a coated abrasive article comprising:

a backing having a first major surface and a second major surface opposite the first major surface;

an abrasive layer on at least a portion of the first major surface, the abrasive layer comprising a binder and abrasive particles;

an adhesive layer on at least a portion of the second major surface; and a removable liner adhered to the adhesive layer, the liner comprising a base portion and a plurality of protrusions extending from the base, wherein the protrusions contact the adhesive layer;

removing the liner from the adhesive layer;

adhering the adhesive layer to a support pad;

frictionally contacting at least a portion of the abrasive layer with at least a portion of the surface of the workpiece; and moving at least one of the abrasive article or the workpiece relative to the other to abrade at least a portion of the surface.

47. A method of abrading a workpiece according to claim 46, wherein the abrasive layer comprises a make layer and a size layer.

48. A method of abrading a workpiece according to claim 46, wherein the abrasive layer comprises a slurry layer.

49. A method of abrading a workpiece comprising:

providing a nonwoven abrasive article comprising:

a backing having a first major surface and a second major surface opposite the first major surface;

a nonwoven abrasive web on at least a portion of the first major surface, the nonwoven abrasive web comprising an open lofty fiber web, binder, and abrasive particles;

an adhesive layer on at least a portion of the second major surface; and a removable liner adhered to the adhesive layer, the liner comprising a base portion and a plurality of protrusions extending from the base, wherein the protrusions contact the adhesive layer;

removing the liner from the adhesive layer;

adhering the adhesive layer to a support pad;

frictionally contacting at least a portion of the nonwoven abrasive web with at least a portion of the surface of the workpiece; and moving at least one of the abrasive article or the workpiece relative to the other to abrade at least a portion of the surface.

* * * * *

UNITED STATES PATENT AND TRADEMARK OFFICE

CERTIFICATE OF CORRECTION

PATENT NO. : 6,755,878 B2
DATED : June 29, 2004
INVENTOR(S) : Paxton, Richard T.

It is certified that error appears in the above-identified patent and that said Letters Patent is hereby corrected as shown below:

Column 7,
Line 11, delete “Saunders” and insert therefor -- Sanders --.

Column 11,
Line 62, after “pressure” insert -- of --.

Column 14,
Line 62, after “abrasive” delete “,”.

Signed and Sealed this

Seventh Day of September, 2004

JON W. DUDAS
*Director of the United States Patent and Trademark Office*